US011400742B2

(12) United States Patent
Shimogata

(10) Patent No.: US 11,400,742 B2
(45) Date of Patent: Aug. 2, 2022

(54) THERMAL TRANSFER IMAGE-RECEIVING SHEET

(71) Applicant: Dai Nippon Printing Co., Ltd., Tokyo (JP)

(72) Inventor: Takanori Shimogata, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 30 days.

(21) Appl. No.: 17/256,336

(22) PCT Filed: Mar. 28, 2019

(86) PCT No.: PCT/JP2019/013731

§ 371 (c)(1),
(2) Date: Dec. 28, 2020

(87) PCT Pub. No.: WO2020/026523

PCT Pub. Date: Feb. 6, 2020

(65) Prior Publication Data

US 2021/0221158 A1 Jul. 22, 2021

(30) Foreign Application Priority Data

Aug. 3, 2018 (JP) ..... JP2018-147242

(51) Int. Cl.
*B41M 5/34* (2006.01)
*B41M 5/385* (2006.01)
*B41M 5/52* (2006.01)

(52) U.S. Cl.
CPC ..... *B41M 5/345* (2013.01); *B41M 5/385* (2013.01); *B41M 5/5218* (2013.01)

(58) Field of Classification Search
CPC ..... B41M 5/345; B41M 5/385; B41M 5/5218
(Continued)

(56) References Cited

U.S. PATENT DOCUMENTS 6,544,713 B2 4/2003 Aylward et al.
8,709,690 B2 4/2014 Nakamura et al.
2021/0221158 A1* 7/2021 Shimogata ..... B41M 5/385

FOREIGN PATENT DOCUMENTS

CN 1407397 A 4/2003
CN 101968612 A 2/2011
(Continued)

OTHER PUBLICATIONS

International Search Report and Written Opinion (Application No. PCT/JP2019/013731) dated May 21, 2019.
(Continued)

*Primary Examiner* — Betelhem Shewareged
(74) *Attorney, Agent, or Firm* — Burr & Brown, PLLC

(57) ABSTRACT

A thermal transfer image-receiving sheet has a primer layer and a receiving layer. The primer layer contains binder resin and metal pigment. When a value obtained by dividing the mass of the metal pigment by the mass of the binder resin is A and the thickness of the primer layer is B, A is 0.5 to 3.5, and A/B is 0.15 to 6. When light is made incident on the surface on the receiving layer side at an incident angle of 45°, ΔL* between L* at a light-receiving angle obtained by tilting specular reflection light, generated when light is made incident on the surface on the receiving layer side at an incident angle of 45°, toward the incident light side by 15° and L* at a light-receiving angle obtained by tilting the specular reflection light toward the incident light side by 110° is 110 or more.

20 Claims, 3 Drawing Sheets

(58) Field of Classification Search
USPC ..... 428/32.5
See application file for complete search history.

(56) References Cited

FOREIGN PATENT DOCUMENTS

| | | | |
|---|---|---|---|
| JP | H08-090937 | A | 4/1996 |
| JP | H10-329434 | A1 | 12/1998 |
| JP | 2000-158830 | A1 | 6/2000 |
| JP | 2006-182012 | A1 | 7/2006 |

OTHER PUBLICATIONS

Korean Office Action (Application No. 10-2020-7025022) dated Feb. 22, 2022 (with English translation).

* cited by examiner

THERMAL TRANSFER IMAGE-RECEIVING SHEET

TECHNICAL FIELD

The present invention relates to a thermal transfer image-receiving sheet.

BACKGROUND ART

As a process for producing a print having a thermal transferred image, there is known a sublimation type thermal transfer method in which a thermal transfer sheet comprising a colorant layer containing a sublimable dye and a thermal transfer image-receiving sheet comprising a receiving layer are combined, and a sublimable dye contained in the colorant layer of the thermal transfer sheet is allowed to migrate to the receiving layer of the thermal transfer image-receiving sheet by applying energy to the thermal transfer sheet to thereby form a thermal transferred image (e.g., see Patent Literature 1). With recent diversifying applications of prints, there is also a need to form prints having designability of a metallic appearance, for example, photographs having a metallic appearance, using the sublimation type thermal transfer method.

When thermal transfer image-receiving sheets or prints in which a thermal transferred image is formed on a thermal transfer image-receiving sheet are stacked into a bundle, the thermal transfer image-receiving sheets used for formation of prints are also required to have a good handling property for easily aligning the four corners of the bundle. A receiving layer of such a thermal transfer image-receiving sheet is required to have good transferability (may be referred to as releasability) capable of preventing fusion between the receiving layer and a colorant layer or between the receiving layer and a protective layer, or transfer of the receiving layer, which is intended to remain essentially on the thermal transfer image-receiving sheet side, onto the colorant layer side or the protective layer side, when a sublimable dye contained in the colorant layer is allowed to migrate onto the receiving layer of the thermal transfer image-receiving sheet to form a print or when the protective layer is transferred onto the receiving layer of the thermal transfer image-receiving sheet.

CITATION LIST

Patent Literature

Patent Literature 1: Japanese Patent Laid-Open No. 2006-182012

SUMMARY OF INVENTION

Technical Problem

The present invention has been made in view of such circumstances, and the present invention aims principally to provide a thermal transfer image-receiving sheet with which a print having designability of a metallic appearance can be produced and which has a good handling property and transferability.

Solution to Problem

A thermal transfer image-receiving sheet according to an embodiment of the present disclosure for solving the above problems is a thermal transfer image-receiving sheet in which a primer layer and a receiving layer are provided in this order on one surface of a support, wherein the primer layer contains a binder resin and a metal pigment, when a value obtained by dividing the total mass of the metal pigment contained in the primer layer by the total mass of the binder resin contained in the primer layer is denoted as A and the thickness of the primer layer is denoted as B (unit: μm), A is 0.5 or more and 3.5 or less, and a value obtained by dividing A by B is 0.15 or more and 6 or less, and ΔL* between L* at a light-receiving angle obtained by tilting specular reflection light, generated when light is made incident on the surface on the receiving layer side at an incident angle of 45°, toward the incident light side by 15° and L* at a light-receiving angle obtained by tilting the specular reflection light toward the incident light side by 110° is 110 or more.

In the thermal transfer image-receiving sheet described above, the primer layer may contain an aluminum pigment as the metal pigment.

In the thermal transfer image-receiving sheet described above, the receiving layer may contain either one or both of a colorant and a pearl pigment.

Alternatively, in the thermal transfer image-receiving sheet described above, an intermediate layer containing either one or both of a colorant and a pearl pigment may be located between the primer layer and the receiving layer.

Alternatively, in the thermal transfer image-receiving sheet described above, an intermediate layer containing a pearl pigment and an intermediate layer containing a colorant may be located in any order between the primer layer and the receiving layer.

Alternatively, in the thermal transfer image-receiving sheet described above, the primer layer may contain either one or both of a colorant and a pearl pigment.

In the thermal transfer image-receiving sheet described above, the ΔL* may be 110 or more and 135 or less.

Advantageous Effects of Invention

According to the thermal transfer image-receiving sheet of the present invention, it is possible to produce a print having designability of a metallic appearance and improve the handling property and transferability.

DESCRIPTION OF EMBODIMENTS

Figure 1:
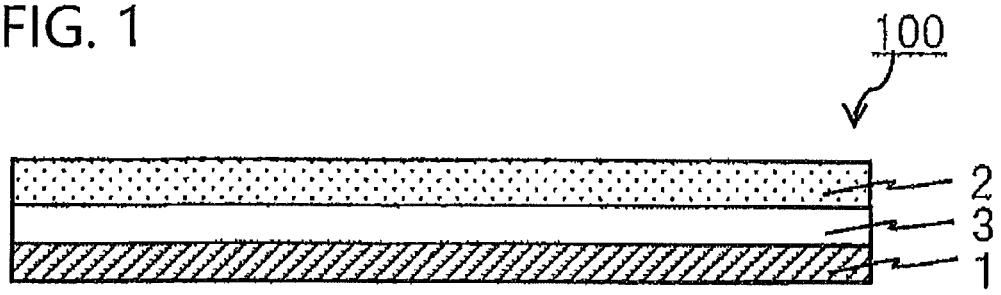
FIG. 1 is a schematic cross-sectional view showing an exemplary thermal transfer image-receiving sheet of the present disclosure.

Hereinafter, embodiments of the present invention will be described with reference to the drawings. The present invention may be embodied in many different aspects and should not be construed as being limited to the description of the exemplary embodiments below. In the drawings, components may be shown schematically regarding the thickness, shape and the like of each layer, compared with actual aspects, for the sake of clearer illustration. The schematic drawings are merely examples and do not limit the interpretations of the present invention in any way. In the specification of the present application and the drawings, components that have substantially the same functions as those described before with reference to previous drawings bear the identical reference signs thereto, and detailed descriptions thereof may be appropriately omitted.

«Thermal Transfer Image-Receiving Sheet»

Figure 6:
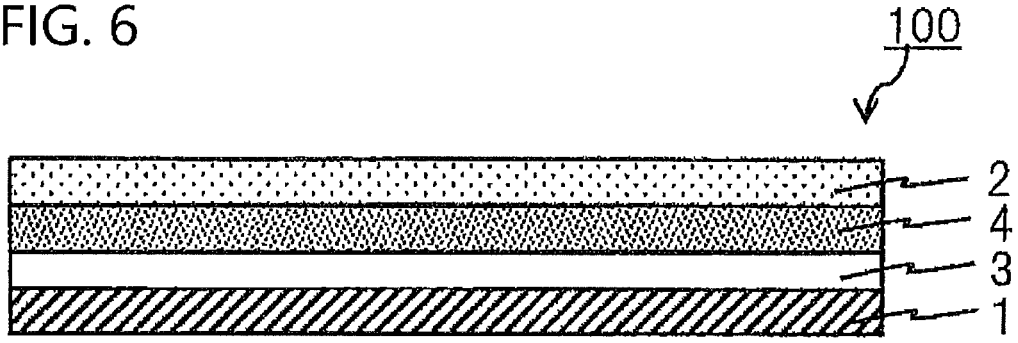
FIG. 6 is a schematic cross-sectional view showing an exemplary thermal transfer image-receiving sheet of the present disclosure.
Figure 7:
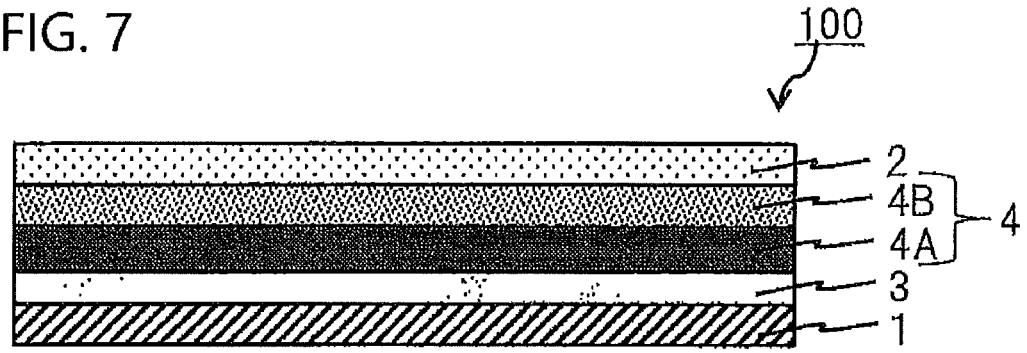
FIG. 7 is a schematic cross-sectional view showing an exemplary thermal transfer image-receiving sheet of the present disclosure.

Hereinbelow, a thermal transfer image-receiving sheet according to embodiments of the present disclosure (hereinbelow, it is referred to as the thermal transfer image-receiving sheet of the present disclosure) will be described. As shown in FIGS. 1 to 4, a thermal transfer image-receiving sheet 100 of the present disclosure has a structure in which a primer layer 3 and a receiving layer 2 are layered in this order on one surface of a support 1 (upper surface in the aspect shown). FIGS. 1 to 4 are schematic cross-sectional views each showing an exemplary thermal transfer image-receiving sheet 100 of the present disclosure. The thermal transfer image-receiving sheet 100 of the present disclosure is not limited to the aspects shown. As shown in FIGS. 6 and 7, constituents other than the support 1, the primer layer 3 and the receiving layer 2 may be included. For example, an intermediate layer of a single-layer structure or a layered structure may be provided between the primer layer 3 and the receiving layer 2. In the aspects shown in FIGS. 6 and 7, a back surface layer 8 may be provided on the other surface of the support. Alternatively, the support 1 may have a multi-layer structure. Alternatively, each of these figures may be appropriately combined with the constituents of the thermal transfer image-receiving sheet 100.

Hereinbelow, each constituent of the thermal transfer image-receiving sheet 100 of the present disclosure will be concretely explained.

(Support)

Figure 2:
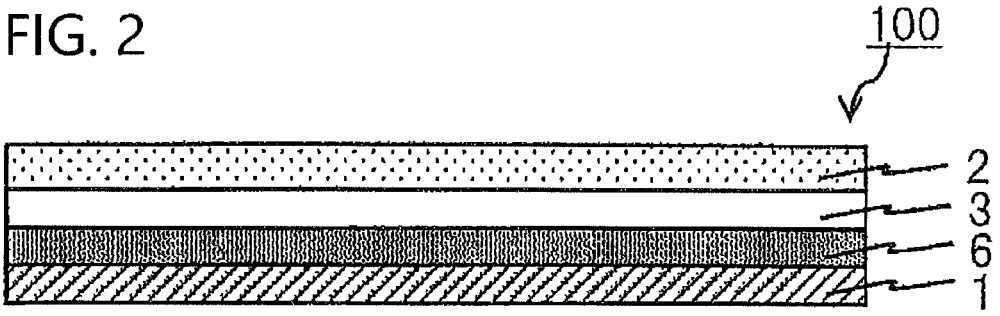
FIG. 2 is a schematic cross-sectional view showing an exemplary thermal transfer image-receiving sheet of the present disclosure.
Figure 3:
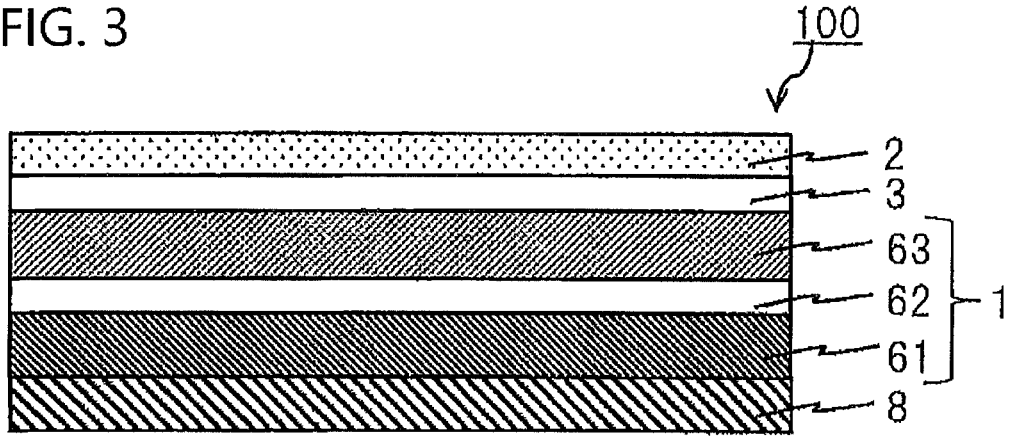
FIG. 3 is a schematic cross-sectional view showing an exemplary thermal transfer image-receiving sheet of the present disclosure.
Figure 4:
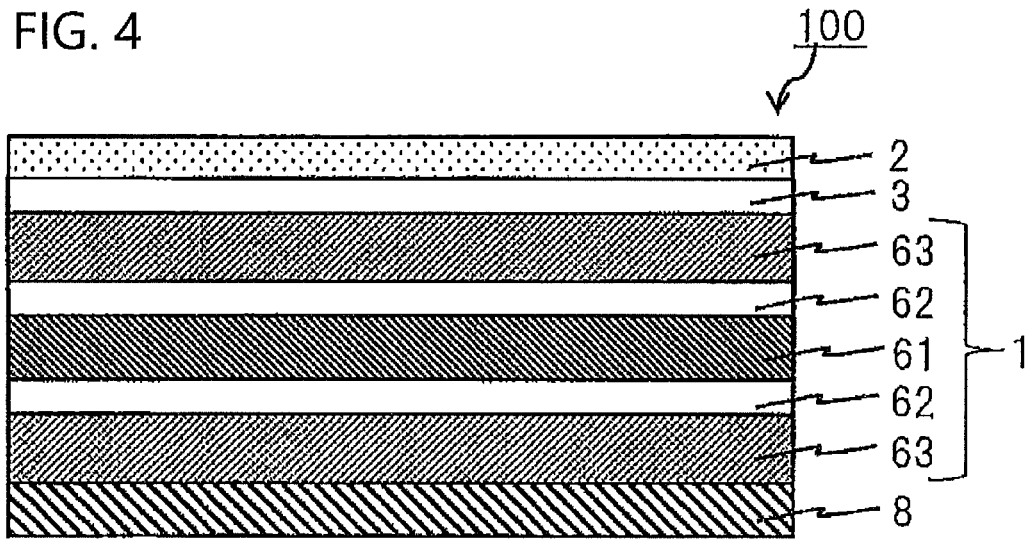
FIG. 4 is a schematic cross-sectional view showing an exemplary thermal transfer image-receiving sheet of the present disclosure.

The support 1 of the thermal transfer image-receiving sheet 100 supports the primer layer 3 and the receiving layer 2. The support 1 may have a single-layer structure as shown in FIGS. 1 and 2 or may have a multi-layer structure as shown in FIGS. 3 and 4. The support 1 in the aspect shown in FIG. 3 has a layered structure in which a substrate 61, an adhesive layer 62, and a film 63 are layered in this order. The support 1 in the aspect shown in FIG. 4 has a layered structure in which a film 63, an adhesive layer 62, a substrate 61, an adhesive layer 62, and a film 63 are layered in this order. Examples of the support 1 of a single-layer structure include a support 1 constituted by a substrate 61 and a support 1 constituted by a film 63.

Examples of the substrate 61 that may constitute the support 1 can include wood-free paper, coated paper, resin coated paper, art paper, cast coated paper, cardboard, synthetic paper (polyolefin-based and polystyrene-based), synthetic resin- or emulsion-impregnated paper, synthetic rubber latex-impregnated paper, synthetic resin-filled paper, cellulose fiber paper, and various plastic films or sheets of polyolefins, polyvinyl chloride, polyethylene terephthalate, polystyrene, polymethacrylate, and polycarbonate. There is no particular limitation with respect to the thickness of the substrate 61, and the thickness is usually 10 μm or more and 300 μm or less, preferably 110 μm or more and 140 μm or less. Commercially available substrates can also be used. For example, resin coated paper (STF-150, Mitsubishi Paper Mills Limited), coated paper (AURORA COAT, NIPPON PAPER INDUSTRIES CO., LTD.), and the like can be suitably used.

Examples of the film 63 that may constitute the support 1 can include stretched or unstretched films of plastics including polyesters having high heat resistance such as polyethylene terephthalate and polyethylene naphthalate, polyolefins, polypropylene, polycarbonate, cellulose acetate, polyethylene derivatives, polyamides, and polymethylpentene, white opaque films obtained by adding a white pigment and a filler to these synthetic resins and forming them into a film, and films having voids therein.

When the support 1 has a layered structure including the substrate 61 and the film 63 as shown in FIGS. 3 and 4, the film 63 to be layered on the receiving layer 2 side is preferably a film having voids. Use of a film having voids can improve the heat insulation performance of the thermal transfer image-receiving sheet 100 to thereby enable a thermal transferred image having a high density to be formed on the receiving layer 2. A film having voids can be obtained by a methods exemplified below or the like. One is a method of kneading inorganic particulates into a polymer and generating voids using the inorganic particulates as nuclei during drawing the compound. Another is a method in which one or more incompatible polymers may be blended into a base resin to prepare a compound. When this compound is microscopically viewed, polymer units form a fine sea-island structure. When this compound is drawn, delamination of the sea-island interface or major deformation of the polymer forming islands leads to generation of voids. The thickness of the film having voids described above is usually 10 μm or more and 100 μm or less, preferably 20 μm or more and 50 μm or less. As shown in FIGS. 3 and 4, instead of or in addition to use of a support 1 having a layered structure, a heat insulation layer 6 is provided between the support 1 and the receiving layer 2 (between the support 1 and the primer layer 3 in the aspect shown in FIG. 2). As this heat insulation layer 6, a film having voids or the like can be used. Alternatively, a heat insulation layer conventionally known in the field of thermal transfer image-receiving sheets can be appropriately selected and used.

Additionally, an adhesive layer 62 may be provided between the substrate 61 and the film 63. The adhesive layer 62 for use in bonding and adhesion of the substrate 61 and the film 63 contains an adhesive and has an adhesive function. Examples of the adhesive component can include polyurethane, polyolefins such as α-olefin-maleic anhydride resins, polyesters, acrylic resins, epoxy resins, urea resins, melamine resins, phenol resins, vinyl acetate, and cyanoacrylate. Among them, reactive-type acrylic resins, modified acrylic resins, and the like can be preferably used. Curing the adhesive by use of a curing agent is preferred because both the adhesive force and heat resistance are improved. As the curing agent, isocyanate compounds are common, but aliphatic amines, alicyclic amines, aromatic amines, acid anhydrides, and the like can be used.

The thickness of the adhesive layer 62 is usually in the range of 2 μm or more and 10 μm or less in the dried state. The adhesive layer can be formed by dispersing or dissolving the adhesive exemplified above and additives to be added as required in a suitable solvent to prepare a coating liquid for adhesive layer, coating this coating liquid onto the substrate 61, and then drying the coated liquid.

The substrate 61 and the film 63 may be bonded to each other by means of EC sandwich lamination, in which polyethylene and the like are employed, instead of bonding the substrate 61 and the film 63 to each other by use of the adhesive layer 62 described above.

(Primer Layer)

The primer layer 3 is provided on the support 1. Here, in the thermal transfer image-receiving sheet 100 of the present disclosure, the primer layer 3 satisfies the following conditions 1 to 3.

(Condition 1): The primer layer contains a binder resin and a metal pigment, and a value "A" obtained by dividing the total mass of the metal pigment contained in the primer layer 3 by the total mass of the binder resin contained in the primer layer 3 is 0.5 or more and 3.5 or less.

(Condition 2): When the thickness of the primer layer 3 is denoted as "B" (unit: μm), the value obtained by dividing the above-described "A" by "B" ("A/B") is 0.15 or more and 6 or less.

(Condition 3): ΔL* between L* at a light-receiving angle obtained by tilting specular reflection light, generated when light is made incident on the surface on the receiving layer 2 side at an incident angle of 45°, toward the incident light side by 15° and L* at a light-receiving angle obtained by tilting the specular reflection light toward the incident light side by 110° is 110 or more. Hereinbelow, ΔL* between L* at a light-receiving angle obtained by tilting specular reflection light, generated when light is made incident on the surface on the receiving layer 2 side at an incident angle of 45°, toward the incident light side by 15° and L* at a light-receiving angle obtained by tilting the specular reflection light toward the incident light side by 110° may be abbreviated as ΔL* between the light-receiving angle of 15° and the light-receiving angle of 110°.

According to the thermal transfer image-receiving sheet 100 of the present disclosure having the primer layer 3 satisfying the above-described conditions 1 to 3, it is possible to produce a print having a metallic appearance by using the thermal transfer image-receiving sheet 100. It is also possible to improve the handling property and transferability of the thermal transfer image-receiving sheet. The handling property referred to herein is an index indicating the degree of ease of alignment when thermal transfer image-receiving sheets or prints in which a thermal transferred image is formed on the thermal transfer image-receiving sheet are stacked into a bundle. The phrase "the handling property is good" means that thermal transfer image-receiving sheets or prints in which a thermal transferred image is formed on the thermal transfer image-receiving sheet can be easily aligned into a bundle. The transferability referred to herein is an index indicating the degree of prevention of fusion between a receiving layer and a colorant layer or fusion between a receiving layer and a protective layer or of unintentional transfer of a receiving layer to the colorant layer side or the protective layer side when a thermal transferred image is formed on the receiving layer of a thermal transfer image-receiving sheet or when the protective layer is transferred onto the thermal transfer image-receiving sheet. The phrase "the transferability is good" means that fusion and unintentional transfer of the receiving layer can be prevented.

The thermal transfer image-receiving sheet of the present disclosure with which a print having designability of a metallic appearance can be produced is provided not only due to the above-described condition 3 but also due to the synergistic effect of the above-described conditions 1 and 2. Even when the condition 3 is satisfied, it is not possible to produce a print having designability of a metallic appearance unless the conditions 1 and 2 are satisfied. Further, if neither of the conditions 1 nor 2 are satisfied, it is not possible to improve both the handling property and the transferability.

In the thermal transfer image-receiving sheet of a preferred aspect of the present disclosure, ΔL* between the light-receiving angle of 15° and the light-receiving angle of 110° is 110 or more and 135 or less, more preferably 120 or more and 130 or less. According to the thermal transfer image-receiving sheet of this aspect, it is possible to impart novel designability having a good metallic appearance while suppressing specularity (it may be referred to as a mirror property).

Figure 5:
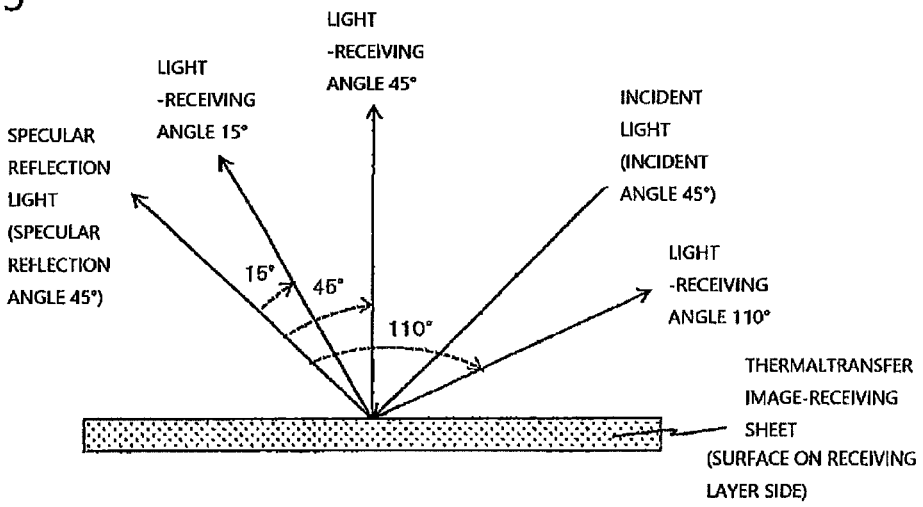
FIG. 5 is a schematic view showing the relation among an incident angle, a specular reflection angle, and light-receiving angles.

ΔL* between L* at a light-receiving angle obtained by tilting specular reflection light, generated when light is made incident on the surface on the receiving layer side at an incident angle of 45°, toward the incident light side by 15° and L* at a light-receiving angle obtained by tilting the specular reflection light toward the incident light side by 110°, referred to herein, can be measured and calculated in compliance with JIS-Z-8781-4 (2013) by a gonio-colorimeter, meaning Δ (L* at a light-receiving angle obtained by tilting specular reflection light toward the incident light side by 15°-L* at a light-receiving angle obtained by tilting the specular reflection light toward the incident light side by 110°). FIG. 5 is a schematic view showing the relation of the incident angle, specular reflection angle, and light-receiving angles, and in the schematic view shown in FIG. 5, light is made incident at an incident angle of 45° with respect to the surface of the receiving layer 2 of the thermal transfer image-receiving sheet. The light-receiving angle of 15° shown in FIG. 5 is a light-receiving angle obtained by tilting specular reflection light toward the incident light side by 15°, and the light-receiving angle of 110° shown in FIG. 5 is a light-receiving angle obtained by tilting the specular reflection light toward the incident light side by 110°. As the gonio-colorimeter, a GC-2000 (NIPPON DENSHOKU INDUSTRIES CO., LTD.) was used. The incident light is set such that ΔL* between L* at a light-receiving angle obtained by tilting specular reflection light, generated when light is made incident to a white standard plate at an incident angle of 45°, toward the incident light side by 15° and L* at a light-receiving angle obtained by tilting the specular reflection light toward the incident light side by 110° is 50±5. The white standard plate used was a genuine standard plate attached to the gonio-colorimeter described above (GC-2000, NIPPON DENSHOKU INDUSTRIES CO., LTD.). The wavelength was that of a D65 light source (view angle of 2°).

Further, it is possible to impart a good handling property and good transferability to the thermal transfer image-receiving sheet 100 while maintaining designability of a metallic appearance imparted to the thermal transfer image-receiving sheet by causing the primer layer 3 to satisfy the above-described conditions 1 and 2.

It is also possible to prevent charging of the primer layer 3 in addition to the effect described above by causing the primer layer 3 to satisfy the above-described condition 1.

Specifically, metal pigment constituents contained in the primer layer 3 will come into electrical contact with one another thereby the charging to be easily attenuated by setting the above-described "A" to 0.5 or more. Alternatively, it is possible to improve the strength of the primer layer 3 by setting "A" to 3.5 or less.

The above-described "A" of the primer layer 3 is preferably 0.75 or more and 3.5 or less, more preferably 0.75 or more and 3 or less. It is possible to further improve the handling property and the transferability by setting the above-described "A" of the primer layer 3 to a preferable numerical value. It is possible to further improve the handling property and the transferability and to impart better designability of a metallic appearance by setting the above-described "A" of the primer layer 3 to 1.2 or more and 2 or less.

The above-described "A/B" of the primer layer 3 is preferably 0.3 or more and 6 or less, more preferably 0.3 or more and 2 or less, even more preferably 0.7 or more and 2 or less, particularly preferably 0.75 or more and 2 or less. It is possible to further improve the handling property and the transferability by setting the above-described "A/B" of the primer layer 3 to a preferable numerical value. It is also possible to impart better designability of a metallic appearance.

The thickness of the primer layer 3 "B" is preferably 0.7 μm or more and 3 μm or less, more preferably 0.8 μm or more and 2.5 μm or less.

The 45° surface glossiness on the receiving layer 2 side of the thermal transfer image-receiving sheet 100 of the present disclosure is preferably 85 or more. It is possible to impart a good metallic appearance by the thermal transfer image-receiving sheet 100 by setting the surface glossiness to 85 or more while ΔL* between the light-receiving angle of 15° and the light-receiving angle of 110° is set to 110 or more. The surface glossiness can be measured using a glossiness meter (Gloss meter VG7000 (NIPPON DENSHOKU INDUSTRIES CO., LTD.)).

When the thermal transfer image-receiving sheet 100 of the present disclosure is viewed in a plane, from the receiving layer 2 side, at an observation magnification of 1000 times, the concealment ratio of the surface of the support 1 with the metal pigment is preferably 70% or more and 90% or less. The concealment ratio of the support 1 with the metal pigment can be determined by observing the surface state of the thermal transfer image-receiving sheet using a digital microscope (VHX-500, KEYENCE CORPORATION) at an observation magnification of 1000 times, 8-bit monochromatizing the observation screen using image analysis software (Image J, U.S. National Institute of Health), then adjusting the threshold (binarization), and dividing the 0 gradation (black area) by the sum of the 255 gradation (white area) and 0 gradation (black area).

The metal pigment contained in the primer layer 3 may be any metal pigment as long as the above-described conditions 1 to 3 are satisfied. The metal pigment referred to herein means a metal pigment having a core structure composed only of a core portion constituted by a metal, and a metal pigment having a core-shell structure in which a core portion is constituted by a metal and coated with a shell portion. In other words, the metal pigment means a pigment made of a metal and a pigment having a coated metal surface. Examples of metals constituting the core portion of metal pigments having a core structure or core-shell structure can include aluminum, nickel, tin, chromium, indium, titanium, gold, silver, copper, and zinc. Examples of the shell portion constituting metal pigments having a core-shell structure can include metal oxides such as titanium oxide and resins such as acrylic resins. Among these metal pigments, a metal pigment having a core structure of which core portion is made of aluminum or a metal pigment having a core-shell structure of which core portion is made of aluminum and of which shell portion is made of a resin is preferred, in the respect of enabling the designability of a metallic appearance to be further improved.

There is no limitation with respect to the shape of the metal pigment, and pigments of various shapes such as granular, tabular, bulky, scaly shapes can be used. Among these, a scaly-shaped metal pigment is preferred in respect of enabling the designability of a metallic appearance to be further improved.

There is no limitation with respect to the average particle size of the metal pigment, and an example thereof is 5 μm or more and 35 μm or less. The average particle size of the metal pigment referred to herein is an average particle size measured using a particle size distribution meter (Microtrac® MT3000 (Nikkiso Co., Ltd.).

There is no limitation with respect to the content of the metal pigment, and the content may be any content as long as the above-described conditions 1 to 3 are satisfied. The content of the metal pigment is preferably 30% by mass or more and 80% by mass or less, more preferably, 30% by mass or more and 75% by mass or less, even more preferably, 55% by mass or more and 65% by mass or less, based on the total mass of the primer layer 3.

There is no particular limitation with respect to the binder resin contained in the primer layer 3, and examples thereof can include polyurethane, acrylic resins, polyethylene, polypropylene, epoxy resins, and polyesters. Binder resins having adhesion other than this also may be appropriately selected and used. The primer layer 3 may contain one binder resin singly or may contain two or more binder resins.

There is no limitation with respect to the content of the binder resin, and the content may be any content as long as the above-described conditions 1 to 3 are satisfied. The content of the binder resin is preferably 20% by mass or more and 70% by mass or less, more preferably 25% by mass or more and 70% by mass or less, even more preferably 35% by mass or more and 45% by mass or less, based on the total mass of the primer layer 3.

The primer layer 3 may also contain a component other than the metal pigment and the binder resin provided that the above-described conditions 1 to 3 are satisfied.

There is no particular limitation with respect to a method for producing the primer layer. The primer layer can be formed by dispersing or dissolving a binder resin, a metal pigment, and optional additives to be added as required in a suitable solvent to prepare a coating liquid for primer layer, coating this coating liquid onto the support 1 or an optional layer to be provided on the support 1 (a heat insulation layer 6 in the aspect shown in FIG. 2), and drying the coated liquid. There is no particular limitation with respect to the method for coating the coating liquid for primer layer, and any conventionally known coating method can be appropriately selected and used. As the coating method, for example, the gravure printing method, the screen printing method, the reverse coating method using a gravure plate, and the like may be enumerated. Coating methods other than these methods may be also used. The same applies to coating methods for various coating liquids described below.

(Receiving Layer)

The receiving layer 2 provided on the primer layer 3 contains a binder resin having a dye-receiving ability. Examples of the binder resin having a dye-receiving ability can include polyolefins such as polypropylene, halogenated resins such as polyvinyl chloride or polyvinylidene chloride, vinyl resins such as polyvinyl acetate, vinyl chloride-vinyl acetate copolymer, ethylene-vinyl acetate copolymer, or polyacrylic esters, polyesters such as polyethylene terephthalate or polybutylene terephthalate, polystyrenes, polyamides, copolymers of an olefin such as ethylene or propylene and another vinyl polymer, and polycarbonate. The receiving layer 2 may contain one binder resin having a dye-receiving ability or may contain two or more such resins.

In the thermal transfer image-receiving sheet 100 of the present disclosure, functions of designability of a metallic appearance, a handling property, and transferability are imparted to the primer layer 3, and thus, it is not necessary to impart these functions to the receiving layer 2. Accordingly, it is possible to select the materials for the receiving layer 2 from a wider range and to easily achieve a receiving layer 2 with which formation of a thermal transferred image having a high density and the like are enabled.

There is no particular limitation with respect to the thickness of the receiving layer 2, and the thickness is usually 0.3 μm or more and 10 μm or less.

In the thermal transfer image-receiving sheet 100 of the present disclosure, it is also possible to impart various designability to the thermal transfer image-receiving sheet 100 by causing either one or both of the primer layer 3 and the receiving layer 2 to contain either one or both of a colorant and a pearl pigment. The primer layer 3 or the receiving layer 2 may contain one of these colorant and pearl pigment or may contain two or more of these. The same applies to an intermediate layer 4 to be mentioned below.

For example, either one or both of the primer layer 3 and receiving layer 2 are caused to contain a yellow pigment as a colorant. In conjunction with a metallic appearance to be imparted by the primer layer 3, this enables the thermal transfer image-receiving sheet to have a gold metallic appearance.

Alternatively, either one or both of layers of the primer layer 3 and receiving layer 2 are caused to contain titanium oxide-coated mica as a pearl pigment. In conjunction with a metallic appearance to be imparted by the primer layer 3, this can impart a luxurious feel to the metallic appearance of the thermal transfer image-receiving sheet.

Examples of the colorant can include chromatic pigments or chromatic dyes such as yellow, magenta, and cyan, oxide-coated glass powders such as titanium oxide-coated glass powder and iron oxide-coated glass powder, and scaly foil fragments such as basic lead carbonate, lead hydrogen arsenate, and bismuth oxychloride.

As the pearl pigment, conventionally known pearl pigments can be appropriately selected and used, and examples thereof include oxide-coated micas such as titanium oxide-coated silica, mica titanium, iron oxide-coated mica, iron oxide-coated mica titanium, Prussian blue-coated mica titanium, Prussian blue-iron oxide-coated mica titanium, chromium oxide-coated mica titanium, carmine-coated mica titanium, organic pigment-coated mica titanium, titanium oxide-coated mica, and titanium oxide-coated synthetic mica, fish scale powder, shell fragments, pearl fragments, and pearl pigment obtained by coating the surface of these with a colored pigment.

When the receiving layer 2 is caused to contain a colorant or a pearl pigment, there is no limitation with respect to the contents of these, and the content is only required to be in the range where the functions of the receiving layer 2 are not inhibited. The content as an examples is 0.1% by mass or more and 10% by mass or less based on the total mass of the receiving layer 2.

When the primer layer 3 is caused to contain a colorant or a pearl pigment, there is no limitation with respect to the content of these, and the content is only required to be in the range where the above-described conditions 1 to 3 are satisfied. The content as an example is 0.1% by mass or more and 10% by mass or less based on the total mass of the primer layer 3.

The primer layer 3 or the receiving layer 2 containing such a colorant or a pearl pigment can be formed by causing the coating liquid described for the primer layer 3 or the receiving layer 2 described above to contain a pearl pigment or a colorant, coating with this coating liquid, and drying the coated liquid. Besides this, after formation of a receiving layer 2 not containing a colorant, the receiving layer 2 can be caused to contain a colorant using a method of causing the colorant to migrate to this receiving layer 2. For example, a thermal transfer sheet comprising a dye layer containing a sublimable dye is used to cause the sublimable dye contained in the dye layer to diffuse and migrate to the receiving layer by a sublimation type thermal transfer method, enabling the receiving layer 2 to contain the colorant.

Alternatively as shown in FIGS. 6 and 7, the thermal transfer image-receiving sheet 100 may be an aspect in which an intermediate layer 4 is provided between the primer layer 3 and the receiving layer 2, and the intermediate layer 4 is caused to contain a colorant and a pearl pigment. FIGS. 6 and 7 are schematic cross-sectional views each showing an exemplary thermal transfer image-receiving sheet 100 of the present disclosure. The thermal transfer image-receiving sheet 100 of the aspect shown in FIG. 6 includes an intermediate layer 4 of a single-layer structure located between the primer layer 3 and the receiving layer 2, and the thermal transfer image-receiving sheet 100 of the aspect shown in FIG. 7 includes an intermediate layer 4 of a layered structure located between the primer layer 3 and the receiving layer 2.

The intermediate layer 4 of the aspect shown in FIG. 6 contains one or both of a colorant and a pearl pigment.

Such an intermediate layer 4 contains one or both of a colorant and a pearl pigment, and a binder resin. Examples of the binder resin include polyesters, urethane resins, epoxy resins, phenol resins, acrylic resins, and vinyl chloride-vinyl acetate copolymers. The same applies to a first intermediate layer 4A and a second intermediate layer 4B to be mentioned below.

There is not limitation with respect to the thickness of the intermediate layer 4, and the thickness is preferably 0.1 μm or more and 8 μm or less, more preferably 0.2 μm or more and 4 μm or less. The same applies to the thickness of the first intermediate layer 4A and the second intermediate layer 4B to be mentioned below.

The intermediate layer 4 of the aspect shown in FIG. 7 has a layered structure in which the first intermediate layer 4A and the second intermediate layer 4B are layered in this order from the primer layer 3 side. In the intermediate layer 4 of the aspect shown in FIG. 7, the first intermediate layer 4A and the second intermediate layer 4B contain either one or both of a colorant and a pearl pigment. Alternatively, the first intermediate layer 4A contains either one of a colorant and a binder resin, and the second intermediate layer 4B contains the other. As an example, the first intermediate layer 4A contains a pearl pigment, and the second intermediate layer 4B contains a colorant. As another example, the first intermediate layer 4A contains a colorant, and the second intermediate layer 4B contains a pearl pigment. Alternatively, the intermediate layer 4 may have a layered structure in which three or more layers are layered and each of the layers is caused to contain a colorant or a pearl pigment. Alternatively, a layer containing neither colorant nor pearl pigment may be provided between the first intermediate layer 4A and the second intermediate layer 4B.

The intermediate layer 4 of the aspects shown in FIGS. 6 and 7 may be combined with a primer layer 3 or a receiving layer 4 containing either one or both of a colorant and a pearl pigment. Alternatively, together with the primer layer 3, the intermediate layer 4 may also contain a metal pigment.

(Back Surface Layer)

As shown in FIGS. 3 and 4, a back surface layer 8 may be provided on the surface of the support 1 opposite to the side on which the receiving layer 2 is provided. The back surface layer 8 is an optional constituent in the thermal transfer image-receiving sheet 100 of the present disclosure.

As the back surface layer 8, those which have a desired function can be appropriately selected and used depending on the applications and the like of the thermal transfer image-receiving sheet 100 of the present disclosure. Among these, preferably used is a back surface layer 8 having a function of improving conveyance of the thermal transfer image-receiving sheet 100, an anti-curl function, and writability. As the back surface layer 8 having such functions, it is possible to use those in which an organic filler such as a nylon filler, an acrylic filler, a polyamide filler, a fluorine filler, a polyethylene wax, or an amino acid-based powder, or an inorganic filler such as silicon dioxide or a metal oxide is added as an additive in a resin such as an acrylic resin, a cellulose resin, polycarbonate, polyvinyl acetal, polyvinyl alcohol, polyvinyl butyral, polyamide, polystyrene, polyester, a halogenated polymer, or the like. Alternatively, as the back surface layer, it is possible to use those obtained by curing these resins with a curing agent such as an isocyanate compound or a chelating compound. The thickness of the back surface layer 8 is usually 0.1 μm or more and 20 μm or less, preferably 0.5 μm or more and 10 μm or less. A back surface primer layer (not shown) may be provided between the support 1 and the back surface layer 8.

«Method for Producing Print»

Next, a method for producing a print according to an embodiment of the present invention (hereinbelow, it is referred to as a method for producing a print of the present disclosure) will be described. The method for producing a print of the present disclosure includes a step of combining a thermal transfer image-receiving sheet 100 having a receiving layer 2 and a thermal transfer sheet having a colorant layer to form a thermal transferred image on the receiving layer 2 using a heating device such as a thermal head. Then, in the method for producing a print of the present disclosure, the thermal transfer image-receiving sheet 100 of the present disclosure described above is used as the thermal transfer image-receiving sheet having a receiving layer 2.

According to the method for producing a print of the present disclosure, a print having designability of a metallic appearance can be obtained using a sublimation type thermal transfer method. It is also possible to improve the handling property of the thermal transfer image-receiving sheets during production of prints or of prints, and additionally transferability during production of prints.

As the thermal transfer sheet having a colorant layer, conventionally known thermal transfer sheets can be appropriately selected and used.

The method for producing a print of the present disclosure may also include a step of forming an optional layer on the receiving layer after the thermal transferred image is formed on the receiving layer. For example, the method may include a step of forming a protective layer on the receiving layer 2 and the like. The optional layer onto the receiving layer 2 may be formed by coating with a coating liquid and drying the coated liquid or may be formed by transfer. The method may include steps other than this step.

EXAMPLES

Hereinbelow, the thermal transfer image-receiving sheet according to the embodiment of the present invention will be described with reference to examples and comparative examples. Note that the expression of "part(s)" herein means that by mass, unless otherwise specified. Note that the amount of a component to be blended shown with its solid content ratio indicates the mass before converted to the solid content.

(Support A)

Polyethylene was melt-extruded onto one surface of wood-free paper having a thickness of 154 μm and a basis weight of 156 g/m$^2$ to form a polyethylene layer having a thickness of 24 μm. Subsequently, polyethylene was melt-extruded onto the other surface of the wood-free paper to form a polyethylene layer having a thickness of 14 μm and additionally a void PP (void polypropylene) film having a thickness of 35 μm was bonded thereon with the polyethylene layer interposed therebetween to thereby provide a support A, in which the polyethylene layer was provided on one surface side of the wood-free paper and the polyethylene layer and the void PP film were layered on the other side.

(Support B)

Polyethylene was melt-extruded onto one surface of coated paper (coated wood-free paper) having a thickness of 150 μm and a basis weight of 180 g/m$^2$ to form a polyethylene layer having a thickness of 24 μm. Subsequently, polyethylene was melt-extruded onto the other surface of the coated paper to form a polyethylene layer having a thickness of 14 μm and additionally a void PP (void polypropylene) film having a thickness of 35 μm was bonded thereon with the polyethylene layer interposed therebetween to thereby provide a support B, in which the polyethylene layer was provided on one surface side of the coated paper and the polyethylene layer and the void PP film were layered on the other side.

Example 1

The support A produced above as a support was used. A coating liquid for primer layer 1 having the following composition was coated onto the surface of this support A on the void PP film side, and the coated liquid was dried to form a primer layer having a thickness of 3 μm. Subsequently, a coating liquid for receiving layer 1 having the following composition was coated onto the primer layer and the coated liquid was dried to form a receiving layer having a thickness of 4 μm, and a thermal transfer image-receiving sheet of Example 1 was obtained in which the primer layer and the receiving layer were layered on the support A.

| <Coating liquid for primer layer 1> | |
|---|---|
| Binder (A) (polyurethane) (Nipolon(R) 5253, TOSOH CORPORATION) | 20 parts |
| Pigment 1 (aluminum pigment (acryl-coated)) | 10 parts |
| Toluene | 75 parts |
| Methyl ethyl ketone | 75 parts |
| <Coating liquid for receiving layer 1> | |
| Vinyl chloride—vinyl acetate copolymer (SOLBIN(R) C, Nissin Chemical Co., Ltd.) | 20 parts |
| Epoxy aralkyl-modified silicone oil (X-22-3000T, Shin-Etsu Chemical Co., Ltd.) | 0.4 parts |
| Methyl ethyl ketone | 70 parts |
| Toluene | 70 parts |

Examples 2 to 29

Thermal transfer image-receiving sheets of Examples 2 to 29 were each obtained exactly in the same manner as in Example 1 except that the coating liquid for primer layer 1 having the composition described above was replaced by a coating liquid for primer layer shown in Table 1 below and a support shown in Table 1 below was used to form a primer layer and a receiving layer having a thickness shown in Table 1 below. The details of the binder resins and the pigments contained in the coating liquids for primer layer in Table 1 are shown in Table 3. The coating liquid for receiving layer used was the coating liquid for receiving layer 1 described above.

Example 30

The support A produced above as a support was used. A coating liquid for primer layer 29 having the following composition was coated onto the surface of this support A on the void PP film side, and the coated liquid was dried to form a primer layer having a thickness of 2 μm. Subsequently, a coating liquid for receiving layer 2 having the following composition was coated onto the primer layer and the coated liquid was dried to form a receiving layer having a thickness of 3.5 μm, and a thermal transfer image-receiving sheet of Example 30 was obtained in which the primer layer and the receiving layer were layered on the support A.

| <Coating liquid for primer layer 29> | |
|---|---|
| Binder (A) (polyurethane) (Nipolon(R) 5253, TOSOH CORPORATION) | 12 parts |
| Pigment 2 (aluminum pigment (no acryl-coating)) | 18 parts |
| Toluene | 75 parts |
| Methyl ethyl ketone | 75 parts |
| <Coating liquid for receiving layer 2> | |
| Vinyl chloride—vinyl acetate copolymer (SOLBIN(R) C, Nissin Chemical Co., Ltd.) | 20 parts |
| Epoxy aralkyl-modified silicone oil (X-22-3000T, Shin-Etsu Chemical Co., Ltd.) | 0.4 parts |
| C.I. Pigment Yellow 83 | 1 part |
| Methyl ethyl ketone | 70 parts |
| Toluene | 70 parts |

Example 31

The support A produced above as a support was used. A coating liquid for primer layer 29 having the composition described above was coated onto the surface of this support A on the void PP film side, and the coated liquid was dried to form a primer layer having a thickness of 1.5 μm. Subsequently, a coating liquid for receiving layer 3 having the following composition was coated onto the primer layer and the coated liquid was dried to form a receiving layer having a thickness of 3.5 μm, and a thermal transfer image-receiving sheet of Example 31 was obtained in which the primer layer and the receiving layer were layered on the support A.

| <Coating liquid for receiving layer 3> | |
|---|---|
| Vinyl chloride—vinyl acetate copolymer (SOLBIN(R) C, Nissin Chemical Co., Ltd.) | 20 parts |
| Epoxy aralkyl-modified silicone oil (X-22-3000T, Shin-Etsu Chemical Co., Ltd.) | 0.4 parts |
| Silver mica (SXB, Nihon Koken Kogyo Co., Ltd.) | 10 parts |
| Methyl ethyl ketone | 70 parts |
| Toluene | 70 parts |

Example 32

The support A produced above as a support was used. A coating liquid for primer layer 29 having the composition described above was coated onto the surface of this support A on the void PP film side, and the coated liquid was dried to form a primer layer having a thickness of 2 μm. Subsequently, a coating liquid for intermediate layer 1 having the following composition was coated onto the primer layer and the coated liquid was dried to form an intermediate layer having a thickness of 0.4 μm. Subsequently, the coating liquid for receiving layer 1 having the composition described above was coated onto the intermediate layer and the coated liquid was dried to form a receiving layer having a thickness of 3.5 μm, and a thermal transfer image-receiving sheet of Example 32 was obtained in which the primer layer, the intermediate layer, and the receiving layer were layered on the support A.

| <Coating liquid for intermediate layer 1> | |
|---|---|
| Binder (A) (polyurethane) (Nipolon(R) 5253, TOSOH CORPORATION) | 20 parts |
| C.I. Pigment Yellow 83 | 0.3 parts |
| Toluene | 75 parts |
| Methyl ethyl ketone | 75 parts |

Example 33

The support A produced above as a support was used. A coating liquid for primer layer 29 having the composition described above was coated onto the surface of this support A on the void PP film side, and the coated liquid was dried to form a primer layer having a thickness of 1.5 μm. Subsequently, a coating liquid for intermediate layer 2 having the following composition was coated onto the primer layer and the coated liquid was dried to form an intermediate layer having a thickness of 1 μm. Subsequently, the coating liquid for receiving layer 1 having the composition described above was coated onto the intermediate layer and the coated liquid was dried to form a receiving layer having a thickness of 3.5 μm, and a thermal transfer image-receiving sheet of Example 33 was obtained in which the primer layer, the intermediate layer, and the receiving layer were layered on the support A.

| <Coating liquid for intermediate layer 2> | |
|---|---|
| Binder (A) (polyurethane) (Nipolon(R) 5253, TOSOH CORPORATION) | 20 parts |
| Silver mica (SXB, Nihon Koken Kogyo Co., Ltd.) | 10 parts |
| Toluene | 75 parts |
| Methyl ethyl ketone | 75 parts |

Example 34

A thermal transfer image-receiving sheet of Example 34 was obtained exactly in the same manner as in Example 33 except that the coating liquid for intermediate layer 2 was replaced by a coating liquid for intermediate layer 3 having the following composition to form an intermediate layer having a thickness of 0.5 μm.

| <Coating liquid for intermediate layer 3> | |
|---|---|
| Binder (A) (polyurethane) (Nipolon(R) 5253, TOSOH CORPORATION) | 20 parts |
| C.I. Pigment Yellow 83 | 0.5 parts |
| Silver mica (SXB, Nihon Koken Kogyo Co., Ltd.) | 9.5 parts |
| Toluene | 75 parts |
| Methyl ethyl ketone | 75 parts |

Example 35

The support A produced above as a support was used. A coating liquid for primer layer 29 having the composition described above was coated onto the surface of this support A on the void PP film side, and the coated liquid was dried to form a primer layer having a thickness of 1.5 μm. Subsequently, the coating liquid for intermediate layer 2 having the composition described above was coated onto the primer layer and the coated liquid was dried to form an intermediate layer having a thickness of 1 μm. Subsequently, a coating liquid for receiving layer 4 having the following composition was coated onto the intermediate layer and the coated liquid was dried to form a receiving layer having a thickness of 3.5 μm, and a thermal transfer image-receiving sheet of Example 35 was obtained in which the primer layer, the intermediate layer, and the receiving layer were layered on the support A.

| <Coating liquid for receiving layer 4> | |
|---|---|
| Vinyl chloride—vinyl acetate copolymer (SOLBIN(R) C, Nissin Chemical Co., Ltd.) | 20 parts |
| Epoxy aralkyl-modified silicone oil (X-22-3000T, Shin-Etsu Chemical Co., Ltd.) | 0.4 parts |
| C.I. Pigment Yellow 83 | 0.2 parts |
| Methyl ethyl ketone | 70 parts |
| Toluene | 70 parts |

Example 36

The support A produced above as a support was used. A coating liquid for primer layer 29 having the composition described above was coated onto the surface of this support A on the void PP film side, and the coated liquid was dried to form a primer layer having a thickness of 1.5 μm. Subsequently, the coating liquid for intermediate layer 1 having the composition described above was coated onto the primer layer and the coated liquid was dried to form an intermediate layer having a thickness of 3.5 μm. Subsequently, the coating liquid for receiving layer 3 having the composition described above was coated onto the intermediate layer and the coated liquid was dried to form a receiving layer having a thickness of 1 μm, and a thermal transfer image-receiving sheet of Example 36 was obtained in which the primer layer, the intermediate layer, and the receiving layer were layered on the support A.

Example 37

The support A produced above as a support was used. A coating liquid for primer layer 29 having the composition described above was coated onto the surface of this support A on the void PP film side, and the coated liquid was dried to form a primer layer having a thickness of 1.5 μm. Subsequently, the coating liquid for intermediate layer 2 having the composition described above was coated onto the primer layer and the coated liquid was dried to form a first intermediate layer having a thickness of 1 μm. Subsequently, the coating liquid for intermediate layer 1 having the composition described above was coated onto the first intermediate layer and the coated liquid was dried to form a second intermediate layer having a thickness of 0.4 μm. Subsequently, the coating liquid for receiving layer 1 having the composition described above was coated onto the second intermediate layer and the coated liquid was dried to form a receiving layer having a thickness of 3.5 μm, and a thermal transfer image-receiving sheet of Example 37 was obtained in which the primer layer, the first intermediate layer, the second intermediate layer, and the receiving layer were layered on the support A.

Reference Example 1

An aluminum vapor deposition layer having a thickness of 0.05 μm was formed by vapor deposition on a surface of the support A on the void PP film side. The coating liquid for receiving layer 1 having the composition described above was coated onto this aluminum vapor deposition layer and the coated liquid was dried to form a receiving layer having a thickness of 4 μm, and a thermal transfer image-receiving sheet of Reference Example 1 was obtained in which the aluminum vapor deposition layer and the receiving layer were layered on the support A.

Comparative Examples 1 to 13

Thermal transfer image-receiving sheets of Comparative Examples 1 to 13 were each obtained exactly in the same manner as in Example 1 except that the coating liquid for primer layer 1 having the composition described above was replaced by a coating liquid for primer layer shown in Table 2 below and a support shown in Table 2 below was used to form a primer layer and a receiving layer having a thickness shown in Table 2 below. The details of the binder resins and the pigments contained in the coating liquids for primer layer in Table 2 are shown in Table 3. The coating liquid for receiving layer used was the coating liquid for receiving layer 1 described above.

TABLE 1

| | | | Primer layer | | | | | Receiving layer |
|---|---|---|---|---|---|---|---|---|
| | | | Binder | | Pigment | | | |
| | Support | Coating liquid | Type | Content (parts) | Type | Content (parts) | Thickness (μm) | Thickness (μm) |
| Example 1 | A | 1 | Binder (A) | 20 | Pigment 1 | 10 | 3 | 4 |
| Example 2 | A | 2 | Binder (A) | 20 | Pigment 1 | 10 | 2.75 | 4 |
| Example 3 | A | 3 | Binder (A) | 20 | Pigment 1 | 10 | 1.7 | 4 |
| Example 4 | A | 4 | Binder (A) | 20 | Pigment 1 | 10 | 0.68 | 4 |
| Example 5 | A | 5 | Binder (A) | 15 | Pigment 1 | 15 | 2.75 | 4 |
| Example 6 | A | 6 | Binder (A) | 15 | Pigment 1 | 15 | 1.7 | 4 |
| Example 7 | A | 7 | Binder (A) | 12 | Pigment 1 | 18 | 2.85 | 4 |
| Example 8 | A | 8 | Binder (A) | 12 | Pigment 1 | 18 | 2 | 4 |
| Example 9 | A | 9 | Binder (A) | 12 | Pigment 2 | 18 | 1.8 | 3.4 |
| Example 10 | A | 10 | Binder (A) | 12 | Pigment 2 | 18 | 1.8 | 4.2 |
| Example 11 | A | 11 | Binder (A) | 12 | Pigment 2 | 18 | 1.4 | 3.4 |
| Example 12 | A | 12 | Binder (A) | 12 | Pigment 2 | 18 | 1.4 | 4.2 |
| Example 13 | A | 13 | Binder (A) | 12 | Pigment 2 | 18 | 1.2 | 3.8 |
| Example 14 | B | 13 | Binder (A) | 12 | Pigment 2 | 18 | 1.2 | 3.8 |
| Example 15 | A | 14 | Binder (A) | 12 | Pigment 1 | 18 | 0.85 | 4 |
| Example 16 | A | 15 | Binder (A) | 12 | Pigment 2 | 18 | 0.8 | 4.2 |
| Example 17 | A | 16 | Binder (A) | 12 | Pigment 2 | 18 | 0.8 | 3.4 |
| Example 18 | A | 17 | Binder (A) | 8.6 | Pigment 1 | 21.4 | 1.2 | 4 |
| Example 19 | A | 18 | Binder (A) | 6.7 | Pigment 1 | 23.3 | 0.6 | 4 |
| Example 20 | A | 19 | Binder (A) | 12 | Pigment 2 | 18 | 1.8 | 4.2 |
| Example 21 | A | 20 | Binder (A) | 12 | Pigment 6 | 18 | 1.8 | 4.2 |
| Example 22 | A | 21 | Binder (A) | 12 | Pigment 7 | 18 | 1.8 | 4.2 |
| Example 23 | A | 22 | Binder (A) | 20 | Pigment 12 | 10.5 | 1.5 | 3.5 |
| Example 24 | A | 23 | Binder (A) | 20 | Pigment 13 | 10.5 | 1.5 | 3.5 |
| Example 25 | A | 24 | Binder (A) | 20 | Pigment 14 | 10.5 | 1.5 | 3.5 |
| Example 26 | A | 25 | Binder (A) | 12 | Pigment 15 | 10 | 1.5 | 3.5 |
| Example 27 | A | 26 | Binder (A) | 20 | Pigment 16 | 10.5 | 1.5 | 3.5 |
| Example 28 | A | 27 | Binder (A) | 20 | Pigment 17 | 10.5 | 1.5 | 3.5 |
| Example 29 | A | 28 | Binder (A) | 20 | Pigment 18 | 10.5 | 1.5 | 3.5 |

TABLE 2

| | | | Primer layer | | | | | Receiving layer |
|---|---|---|---|---|---|---|---|---|
| | | | Binder | | Pigment | | | |
| | Support | Coating liquid | Type | Content (parts) | Type | Content (parts) | Thickness (μm) | Thickness (μm) |
| Comparative Example 1 | A | A | Binder (A) | 30 | — | 0 | 1 | 3.8 |
| Comparative Example 2 | A | B | Binder (A) | 10 | Pigment 3 | 20 | 1 | 3.8 |
| Comparative Example 3 | B | C | Binder (A) | 10 | Pigment 3 | 20 | 1 | 3.8 |
| Comparative Example 4 | A | D | Binder (A) | 10 | Pigment 4 | 20 | 2 | 3.8 |
| Comparative Example 5 | A | E | Binder (A) | 8.6 | Pigment 5 | 21.4 | 2.4 | 3.8 |
| Comparative Example 6 | A | F | Binder (A) | 12 | Pigment 1 | 18 | 0.6 | 4 |
| Comparative Example 7 | A | G | Binder (A) | 8.6 | Pigment 1 | 21.4 | 0.4 | 4 |
| Comparative Example 8 | A | H | Binder (A) | 15 | Pigment 1 | 15 | 0.68 | 4 |
| Comparative Example 9 | A | I | Binder (A) | 24 | Pigment 1 | 6 | 3.5 | 4 |
| Comparative Example 10 | A | J | Binder (A) | 21.4 | Pigment 1 | 8.6 | 3.5 | 4 |
| Comparative Example 11 | A | K | Binder (A) | 6.3 | Pigment 1 | 23.7 | 0.65 | 4 |
| Comparative Example 12 | A | L | Binder (A) | 6.3 | Pigment 1 | 23.7 | 0.4 | 4 |
| Comparative Example 13 | A | M | Binder (A) | 21.4 | Pigment 1 | 8.6 | 1.8 | 4 |

TABLE 3

| Type | Component | Component information |
|---|---|---|
| Binder (A) | Polyurethane | Nipolon(R) 5253, TOSOH CORPORATION |
| Binder (B) | Polyester | POLYESTER(R) WR-905, The Nippon Synthetic Chemical Industry Co., Ltd. |
| Pigment 1 | Aluminum pigment (acryl-coated) | Average particle size: 10 μm |
| Pigment 2 | Aluminum pigment (no resin coating) | Average particle size: 10 μm |
| Pigment 3 | Titanium oxide | Average particle size: less than 1 μm (TCA888, Tochem Products Co., Ltd.) |
| Pigment 4 | Silver mica | Median diameter D50: 13 μm (SXB, Nihon Koken Kogyo Co., Ltd.) |
| Pigment 5 | Gold mica | Median diameter D50: 13 μm (RYXB, Nihon Koken Kogyo Co., Ltd.) |
| Pigment 6 | Pigment 2 + Pigment 4 Blend ratio (Pigment 2:Pigment 4 = 5:1) | |
| Pigment 7 | Pigment 1 + Pigment 2 Blend ratio (Pigment 1:Pigment 2 = 1:1) | |
| Pigment 8 | Yellow pigment | C. I. Pigment Yellow 83 |
| Pigment 9 | Brown pigment | C. I. Pigment Orange 16 |
| Pigment 10 | Red pigment | C. I. Pigment Red 170 |
| Pigment 11 | Blue pigment | C. I. Pigment Blue 15 |
| Pigment 12 | Pigment 2 + Pigment 8 Blend ratio (Pigment 2:Pigment 8 = 20:1) | |
| Pigment 13 | Pigment 1 + Pigment 8 Blend ratio (Pigment 1:Pigment 8 = 20:1) | |
| Pigment 14 | Pigment 2 + Pigment 4 Blend ratio (Pigment 2:Pigment 10 = 20:1) | |
| Pigment 15 | Pigment 2 + Pigment 4 + Pigment 8 Blend ratio (Pigment 2:Pigment 4:Pigment 8 = 15:9:1) | |
| Pigment 16 | Pigment 2 + Pigment 9 Blend ratio (Pigment 2:Pigment 9 = 20:1) | |
| Pigment 17 | Pigment 2 + Pigment 10 Blend ratio (Pigment 2:Pigment 10 = 20:1) | |
| Pigment 18 | Pigment 2 + Pigment 11 Blend ratio (Pigment 2:Pigment 11 = 20:1) | |

Comparative Example 14

A thermal transfer image-receiving sheet of Comparative Example 14 in which the receiving layer was provided on the support A was obtained exactly in the same manner as in Example 1 except that no primer layer was formed and the coating liquid for receiving layer 1 was replaced by a coating liquid for receiving layer 5 having the following composition to form a receiving layer having a thickness of 3.8 μm.

| <Coating liquid for receiving layer 5> | |
|---|---|
| Vinyl chloride—vinyl acetate copolymer (SOLBIN(R) C, Nissin Chemical Co., Ltd.) | 8 parts |
| Epoxy aralkyl-modified silicone oil (X-22-3000T, Shin-Etsu Chemical Co., Ltd.) | 0.4 parts |
| Pigment 2 (aluminum pigment (no resin coating)) (average particle size: 10 μm) | 12 parts |
| Methyl ethyl ketone | 70 parts |
| Toluene | 70 parts |

For the thermal transfer image-receiving sheet of each of Examples and Comparative Examples, "A", a value obtained by dividing the total mass of the metal pigment contained in the primer layer by the total mass of the binder resin contained in the primer layer, and "A/B", a value obtained by dividing "A" by the thickness of the primer layer "B" (unit: μm) are shown in Table 4, Table 5 (Examples), and Table 6 (Comparative Examples).

(ΔL* between light-receiving angle of 15° and light-receiving angle of 110°)

ΔL* between L* at a light-receiving angle of 15° and L* at a light-receiving angle of 110° in the thermal transfer image-receiving sheet of each of Examples, Comparative Examples, and Reference Example 1, measured and calculated by a gonio-colorimeter (GC-2000, NIPPON DENSHOKU INDUSTRIES CO., LTD.), are shown in Tables 4 and 5 (Examples and Reference Example 1) and Table 6 (Comparative Examples). Evaluation A in "ΔL* column" in Tables 4, 5, and 6 means that ΔL* is 110 or more, and Evaluation NG means that ΔL* is less than 110.

(Measurement of Concealment Ratio)

The concealment ratio of the support with the pigment contained in the primer layer (receiving layer in Comparative Example 14) was determined by observing the surface state of the thermal transfer image-receiving sheet of each of Examples and Comparative Examples using a digital microscope (VHX-500, KEYENCE CORPORATION) at an observation magnification of 1000 times, 8-bit monochromatizing the observation screen using image analysis software (Image J, U.S. National Institute of Health), then adjusting the threshold (binarization), and dividing the 0 gradation (black area) by the sum of the 255 gradation (white area) and 0 gradation (black area). The 0 gradation (black area) corresponds to the pigment concealing the support, and the 255 gradation (white area) is a support portion not concealed with the pigment. The measurement results of the concealment ratio are shown in Table 4, Table 5 (Examples), and Table 6 (Comparative Examples).

(Measurement of Glossiness)

The surface of the thermal transfer image-receiving sheet of each of Examples and Comparative Examples was measured was measured using a glossiness meter (Gloss meter VG7000 (NIPPON DENSHOKU INDUSTRIES CO., LTD.)) (measurement angle 45°). The measurement results are shown in Table 4, Table 5 (Example), and Table 6 (Comparative Examples).

(Metallic Appearance Evaluation)

The surface of the thermal transfer image-receiving sheet on the receiving layer side of each of Examples, Comparative Examples, and Reference Example was visually observed, and its metallic appearance was evaluated under the following evaluation criteria. The evaluation results are also shown in Table 4, Table 5 (Examples and Reference Example 1), and Table 6 (Comparative Example). For the thermal transfer image-receiving sheets of Examples 23 to 37, appearance evaluation of the metallic appearance was conducted (see "Appearance" column in Table 5).

"Evaluation Criteria"

A: Having a highly good metallic appearance with specularity suppressed.

B: Having a good metallic appearance with specularity suppressed.

C: Having a metallic appearance equivalent to that of B, but also having graininess.

D: Having a metallic appearance, but specularity is high.

NG (1): The metallic appearance is weak (penetrates the support).

NG (2): Having no metallic appearance.

(Handling Property Evaluation)

The thermal transfer image-receiving sheet of each of Examples and Comparative Examples and a genuine ribbon for a sublimable type thermal transfer printer (DS620, Dai Nippon Printing Co., Ltd.) were combined, and a black solid image (0/255 gradation (image gradation)) was sequentially printed on 10 sheets (size: 6×8) in the gloss mode by a sublimable type thermal transfer printer (DS620, Dai Nippon Printing Co., Ltd.) in an environment of 20° C. and 10% RH. Then, the sticking feeling of prints accumulated in the tray was checked, and the handling property was evaluated under the following evaluation criteria. The evaluation results are also shown in Table 4, Table 5 (Examples), and Table 6 (Comparative Examples).

"Evaluation Criteria"

A: No sticking or no sticking feeling is present.

B: Sticking feeling is present, but there is no problem to use.

NG: Strong sticking, which cause a problem in use, has occurred.

(Transferability Evaluation)

The thermal transfer image-receiving sheet of each of Examples and Comparative Examples and a genuine ribbon for a sublimable type thermal transfer printer (DS620, Dai Nippon Printing Co., Ltd.) were combined, and a black solid image (0/255 gradation (image gradation)) was sequentially printed on two sheets (size: 6×8) in the gloss mode by a sublimable type thermal transfer printer (DS620, Dai Nippon Printing Co., Ltd.) in an environment of 20° C. and 30% RH. The transferability was checked, and the transferability was evaluated under the following evaluation criteria. The evaluation results are also shown in Table 4, Table 5 (Examples), and Table 6 (Comparative Examples).

"Evaluation Criteria"

A: No abnormal transfer is present.

B: A peeling sound has occurred, but no abnormal transfer is present.

NG: The thermal transfer sheet and the receiving layer are fused to each other, or the receiving layer is taken on the thermal transfer sheet side.

(Adhesion Evaluation)

Mending tape was stuck to the receiving layer of the thermal transfer image-receiving sheet of each of Examples and Comparative Examples. When the tape was released at a peel angle of 90°, the state of the tape and the thermal transfer image-receiving sheet was visually checked, and the adhesion was evaluated under the following evaluation criteria. The evaluation results are also shown in Table 4, Table 5 (Examples), and Table 6 (Comparative Examples).

"Evaluation Criteria"

A: The receiving layer and the primer layer strongly adhere to each other, and the receiving layer is not taken on the tape side or the support will be broken.

B: The receiving layer is partially taken on the tape side immediately after the formation of the thermal transfer image-receiving sheet. However, after the sheet was left for one day, the receiving layer and the primer layer strongly adhere to each other, and the receiving layer is not taken on the tape side or the support will be broken.

C: In both the cases, that is, immediately after formation of the thermal transfer image-receiving sheet and after the sheet was left for one day, the receiving layer is partially taken on the tape side, but there is no problem to use.

NG: In both the cases, that is, immediately after formation of the thermal transfer image-receiving sheet and after the sheet was left for one day, the receiving layer easily comes off from the primer layer, and the entire portion of the receiving layer adhering to the tape is taken on the tape side.

TABLE 4

| | A Value | A/B Value | ΔL* Calculated value | ΔL* Evaluation | Concealment ratio (%) | Glossiness | Metallic appearance | Handling property | Transferability | Adhesion |
|---|---|---|---|---|---|---|---|---|---|---|
| Example 1 | 0.5 | 0.17 | 122.5 | A | 85.1 | 60 | C | B | A | C |
| Example 2 | 0.5 | 0.18 | 125.8 | A | 83 | 101.5 | B | B | A | B |
| Example 3 | 0.5 | 0.29 | 121.1 | A | 78.1 | 122.1 | B | B | A | B |
| Example 4 | 0.5 | 0.74 | 128.9 | A | 70.3 | 103.6 | B | B | A | B |
| Example 5 | 1 | 0.36 | 127.5 | A | 85.3 | 68.9 | C | A | A | C |
| Example 6 | 1 | 0.59 | 130.3 | A | 82 | 108.6 | B | A | A | B |
| Example 7 | 1.5 | 0.53 | 131.8 | A | 87.5 | 66.9 | C | A | A | C |
| Example 8 | 1.5 | 0.75 | 125 | A | 82.6 | 89.6 | A | A | A | A |
| Example 9 | 1.5 | 0.83 | 122.5 | A | 81.6 | 96.15 | A | A | A | A |
| Example 10 | 1.5 | 0.83 | 121.9 | A | 81.7 | 100.3 | A | A | A | A |
| Example 11 | 1.5 | 1.07 | 125.3 | A | 80.7 | 101.8 | A | A | A | A |
| Example 12 | 1.5 | 1.07 | 125.7 | A | 80.5 | 104.85 | A | A | A | A |
| Example 13 | 1.5 | 1.25 | 120.5 | A | 79.8 | 107.2 | A | A | A | A |
| Example 14 | 1.5 | 1.25 | 123.9 | A | 87.1 | 109.75 | A | A | A | A |
| Example 15 | 1.5 | 1.76 | 124.8 | A | 74 | 140.1 | A | A | A | A |
| Example 16 | 1.5 | 1.88 | 123.5 | A | 72.2 | 117.9 | A | A | A | A |
| Example 17 | 1.5 | 1.88 | 120.2 | A | 71.9 | 119.6 | A | A | A | A |
| Example 18 | 2.5 | 2.08 | 123.2 | A | 80.8 | 105 | B | A | B | B |
| Example 19 | 3.5 | 5.83 | 114 | A | 85.6 | 82.5 | C | A | B | C |

TABLE 4-continued

| | A Value | A/B Value | ΔL* Calculated value | ΔL* Evaluation | Concealment ratio (%) | Glossiness | Metallic appearance | Handling property | Transferability | Adhesion |
|---|---|---|---|---|---|---|---|---|---|---|
| Example 20 | 1.5 | 0.83 | 122 | A | 80.7 | 102.1 | A | A | A | A |
| Example 21 | 1.25 | 0.69 | 117 | A | 80 | 105 | B | A | A | A |
| Example 22 | 1.5 | 0.83 | 119.5 | A | 81.1 | 100.9 | A | A | A | A |
| Reference Example 1 | — | — | 200.9 | A | — | — | D | — | — | — |

TABLE 5

| | A Value | A/B Value | ΔL* Calculated value | ΔL* Evaluation | Concealment ratio (%) | Glossiness | Metallic appearance | Appearance | Handling property | Transferability | Adhesion |
|---|---|---|---|---|---|---|---|---|---|---|---|
| Example 23 | 0.5 | 0.33 | 116.3 | A | 79.8 | 114.4 | B | Metallic gold appearance | B | A | B |
| Example 24 | 0.5 | 0.33 | 115.5 | A | 77 | 111.2 | B | Metallic gold appearance | B | A | B |
| Example 25 | 0.5 | 0.33 | 110.2 | A | 75.5 | 90.1 | C | Luxurious gold appearance | B | A | B |
| Example 26 | 0.5 | 0.33 | 111 | A | 80.4 | 98.8 | B | Luxurious metallic gold appearance | B | A | B |
| Example 27 | 0.5 | 0.33 | 113.5 | A | 78.8 | 103.5 | B | Bronze appearance | B | A | B |
| Example 28 | 0.5 | 0.33 | 116.2 | A | 74.9 | 107.1 | B | Pink gold appearance | B | A | B |
| Example 29 | 0.5 | 0.33 | 114.4 | A | 76.1 | 111.6 | B | Marine gold appearance | B | A | B |
| Example 30 | 1.5 | 0.75 | 118.4 | A | 84.5 | 81.8 | A | Metallic gold appearance | A | A | A |
| Example 31 | 1.5 | 1 | 116.4 | A | 86.1 | 100.1 | A | Luxurious gold appearance | A | A | A |
| Example 32 | 1.5 | 0.75 | 120.1 | A | 82.1 | 85.4 | A | Luxurious metallic appearance | A | A | A |
| Example 33 | 1.5 | 1 | 115.1 | A | 85 | 104.4 | A | Luxurious gold appearance | A | A | A |
| Example 34 | 1.5 | 1 | 118.5 | A | 84 | 97.7 | A | Luxurious gold appearance | A | A | A |
| Example 35 | 1.5 | 1 | 113.6 | A | 86.1 | 101.1 | B | Luxurious gold appearance | A | A | A |
| Example 36 | 1.5 | 1 | 114.1 | A | 83.6 | 100.3 | A | Luxurious gold appearance | A | A | A |
| Example 37 | 1.5 | 1 | 112.2 | A | 87.8 | 101.4 | A | Luxurious gold appearance | A | A | A |

TABLE 6

| | A Value | A/B Value | ΔL* Calculated value | ΔL* Evaluation | Concealment ratio (%) | Glossiness | Metallic appearance | Handling property | Transferability | Adhesion |
|---|---|---|---|---|---|---|---|---|---|---|
| Comparative Example 1 | 0 | 0 | 62 | NG | 0 | 80.5 | NG(2) | NG | NG | NG |
| Comparative Example 2 | 2 | 2 | 51.8 | NG | 57 | 72.4 | NG(2) | NG | A | B |
| Comparative Example 3 | 2 | 2 | 51 | NG | 57.3 | 74.1 | NG(2) | NG | A | B |
| Comparative Example 4 | 0 | 0 | 83.3 | NG | 60.2 | 59.4 | NG(2) | NG | A | B |
| Comparative Example 5 | 0 | 0 | 77.5 | NG | 58 | 50.7 | NG(2) | NG | A | B |
| Comparative Example 6 | 1.5 | 2.5 | 90.1 | NG | 68.1 | 146.7 | NG(1) | A | A | B |
| Comparative Example 7 | 2.5 | 6.25 | 90 | NG | 69.1 | 146 | NG(1) | A | B | B |
| Comparative Example 8 | 1 | 1.47 | 107.2 | NG | 60.7 | 135.1 | NG(1) | A | A | B |
| Comparative Example 9 | 0.25 | 0.07 | 120.5 | A | 84.1 | 70 | C | NG | A | C |
| Comparative Example 10 | 0.4 | 0.11 | 124 | A | 84.3 | 60 | C | NG | A | C |
| Comparative Example 11 | 3.75 | 5.77 | 122.3 | A | 88.2 | 73.5 | C | A | NG | NG |
| Comparative Example 12 | 3.75 | 9.38 | 117.5 | A | 86.7 | 77.8 | C | A | NG | NG |

TABLE 6-continued

| | A Value | A/B Value | ΔL* Calculated value | ΔL* Evaluation | Concealment ratio (%) | Glossiness | Metallic appearance | Handling property | Transferability | Adhesion |
|---|---|---|---|---|---|---|---|---|---|---|
| Comparative Example 13 | 0.4 | 0.22 | 123.3 | A | 79.1 | 60 | B | NG | A | B |
| Comparative Example 14 | — | | 128 | A | 79.2 | 105 | B | A | NG | B |

REFERENCE SIGNS LIST

100 thermal transfer image-receiving sheet
1 support
2 receiving layer
3 primer layer
4 intermediate layer
4A first intermediate layer
4B second intermediate layer
6 heat insulation layer
8 back surface layer
61 substrate
62 adhesive layer
63 film

The invention claimed is:

1. A thermal transfer image-receiving sheet in which a primer layer and a receiving layer are provided in this order on one surface of a support, wherein the primer layer contains a binder resin and a metal pigment, when a value obtained by dividing the total mass of the metal pigment contained in the primer layer by the total mass of the binder resin contained in the primer layer is denoted as A and the thickness of the primer layer is denoted as B (unit: μm), A is 0.5 or more and 3.5 or less, and a value obtained by dividing A by B is 0.15 or more and 6 or less, and ΔL* between L* at a light-receiving angle obtained by tilting specular reflection light, generated when light is made incident on the surface on the receiving layer side at an incident angle of 45°, toward the incident light side by 15° and L* at a light-receiving angle obtained by tilting the specular reflection light toward the incident light side by 110° is 110 or more.

2. The thermal transfer image-receiving sheet according to claim 1, wherein the primer layer contains an aluminum pigment as the metal pigment.

3. The thermal transfer image-receiving sheet according to claim 1, wherein the receiving layer contains either one or both of a colorant and a pearl pigment.

4. The thermal transfer image-receiving sheet according to claim 1, wherein an intermediate layer containing either one or both of a colorant and a pearl pigment is located between the primer layer and the receiving layer.

5. The thermal transfer image-receiving sheet according to claim 1, wherein an intermediate layer containing a pearl pigment and an intermediate layer containing a colorant are located in any order between the primer layer and the receiving layer.

6. The thermal transfer image-receiving sheet according to claim 1, wherein the primer layer contains either one or both of a colorant and a pearl pigment.

7. The thermal transfer image-receiving sheet according to claim 1, wherein the ΔL* is 110 or more and 135 or less.

8. The thermal transfer image-receiving sheet according to claim 2, wherein the receiving layer contains either one or both of a colorant and a pearl pigment.

9. The thermal transfer image-receiving sheet according to claim 2, wherein an intermediate layer containing either one or both of a colorant and a pearl pigment is located between the primer layer and the receiving layer.

10. The thermal transfer image-receiving sheet according to claim 3, wherein an intermediate layer containing either one or both of a colorant and a pearl pigment is located between the primer layer and the receiving layer.

11. The thermal transfer image-receiving sheet according to claim 2, wherein an intermediate layer containing a pearl pigment and an intermediate layer containing a colorant are located in any order between the primer layer and the receiving layer.

12. The thermal transfer image-receiving sheet according to claim 3, wherein an intermediate layer containing a pearl pigment and an intermediate layer containing a colorant are located in any order between the primer layer and the receiving layer.

13. The thermal transfer image-receiving sheet according to claim 2, wherein the primer layer contains either one or both of a colorant and a pearl pigment.

14. The thermal transfer image-receiving sheet according to claim 3, wherein the primer layer contains either one or both of a colorant and a pearl pigment.

15. The thermal transfer image-receiving sheet according to claim 4, wherein the primer layer contains either one or both of a colorant and a pearl pigment.

16. The thermal transfer image-receiving sheet according to claim 5, wherein the primer layer contains either one or both of a colorant and a pearl pigment.

17. The thermal transfer image-receiving sheet according to claim 2, wherein the ΔL* is 110 or more and 135 or less.

18. The thermal transfer image-receiving sheet according to claim 3, wherein the ΔL* is 110 or more and 135 or less.

19. The thermal transfer image-receiving sheet according to claim 4, wherein the ΔL* is 110 or more and 135 or less.

20. The thermal transfer image-receiving sheet according to claim 5, wherein the ΔL* is 110 or more and 135 or less.

* * * * *